US005423550A

United States Patent [19]

Guthrie

[11] Patent Number: 5,423,550

[45] Date of Patent: Jun. 13, 1995

[54] FOOTBALL GAME

[76] Inventor: Earl C. Guthrie, R.D. 1 Box 398, Smithfield, Pa. 15478

[21] Appl. No.: 312,229

[22] Filed: Sep. 26, 1994

[51] Int. Cl.[6] ..... A63F 3/00

[52] U.S. Cl. ..... 273/247; 273/94

[58] Field of Search ..... 273/247, 94

[56] References Cited

U.S. PATENT DOCUMENTS 543,463 7/1895 Brown ..... 273/247

5,087,051 2/1992 LoBue ..... 273/247

*Primary Examiner*—Benjamin H. Layno

[57] ABSTRACT

A football game wherein a game board includes an outer row of instructional spaces and a plurality of rows of apertures, wherein a player is directed about the instructional spaces to direct play along the instructional spaces and movement along the apertures, wherein movement along the apertures permits a player to obtain a field goal utilizing a die member to award points by chance.

1 Claim, 4 Drawing Sheets

Fig. 1
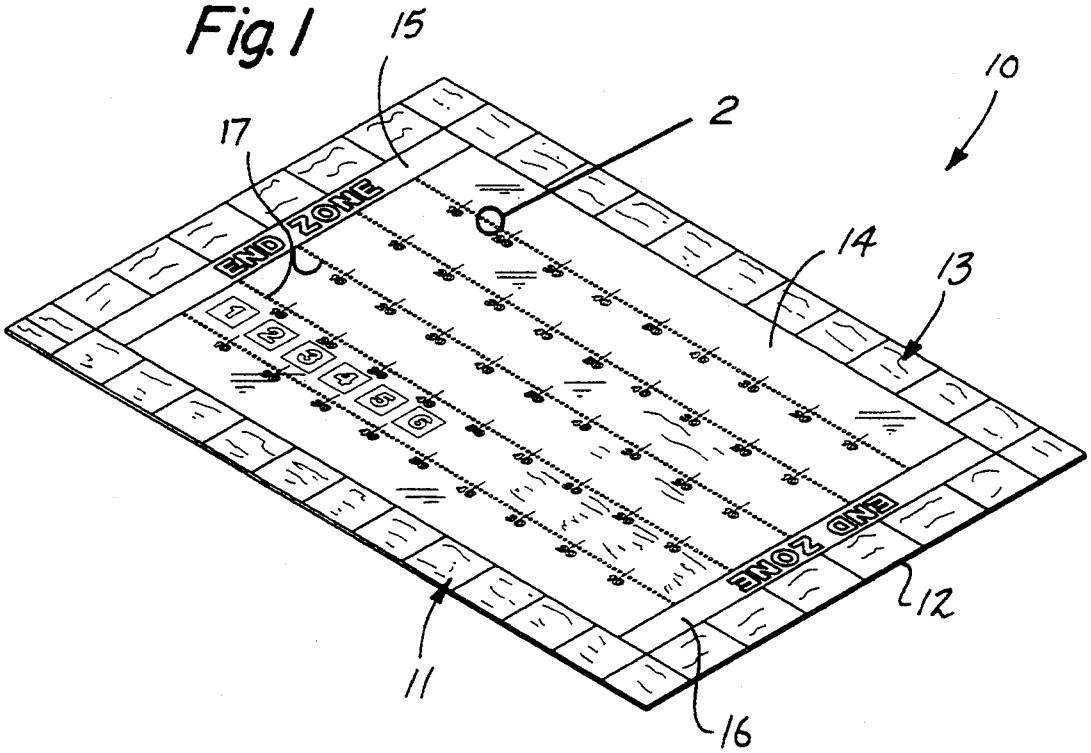
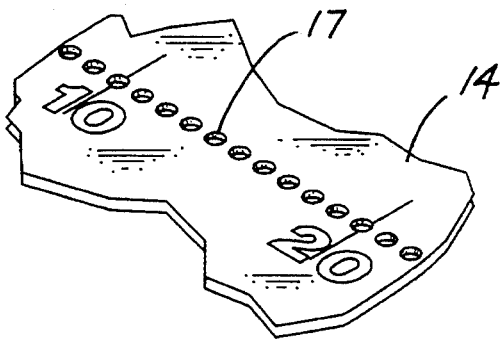
Fig. 2

FOOTBALL GAME

TECHNICAL FIELD

The field of invention relates to football game method and apparatus, and more particularly to a football game wherein the same is directed to the coordination of movement about a playing field consistent with movement about a peripheral playing space row to effect advance and position loss relative to attaining competing point totals.

BACKGROUND OF THE INVENTION

Various football game organizations have been available in the prior art and exemplified by the U.S. Pat. Nos. 5,158,301; 4,514,975; 5,217,229; and 4,019,737.

The instant invention is directed to improvement over the prior art by providing for chance coordination of movement about a playing field, with movement about a peripheral playing instructional row of spaces.

SUMMARY OF THE INVENTION

The present invention relates to a football game including a playing field having an outer peripheral row of playing spaces to effect instruction into the loss and advance along the playing field, with the playing field having competing rows of apertures to support a respective player token in a respective row, wherein movement along the row is coordinated with movement about the outer spaces, with point totals such as field goals and the like being effected by the roll of a die member relative to chance selection of spaces on the playing field, with a similar point after a touchdown being effected by a like chance roll of the die member.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is an isometric illustration of the playing board of the invention.

FIG. 2 is an enlarged, partial isometric illustration of section 2 as set forth in FIG. 1.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
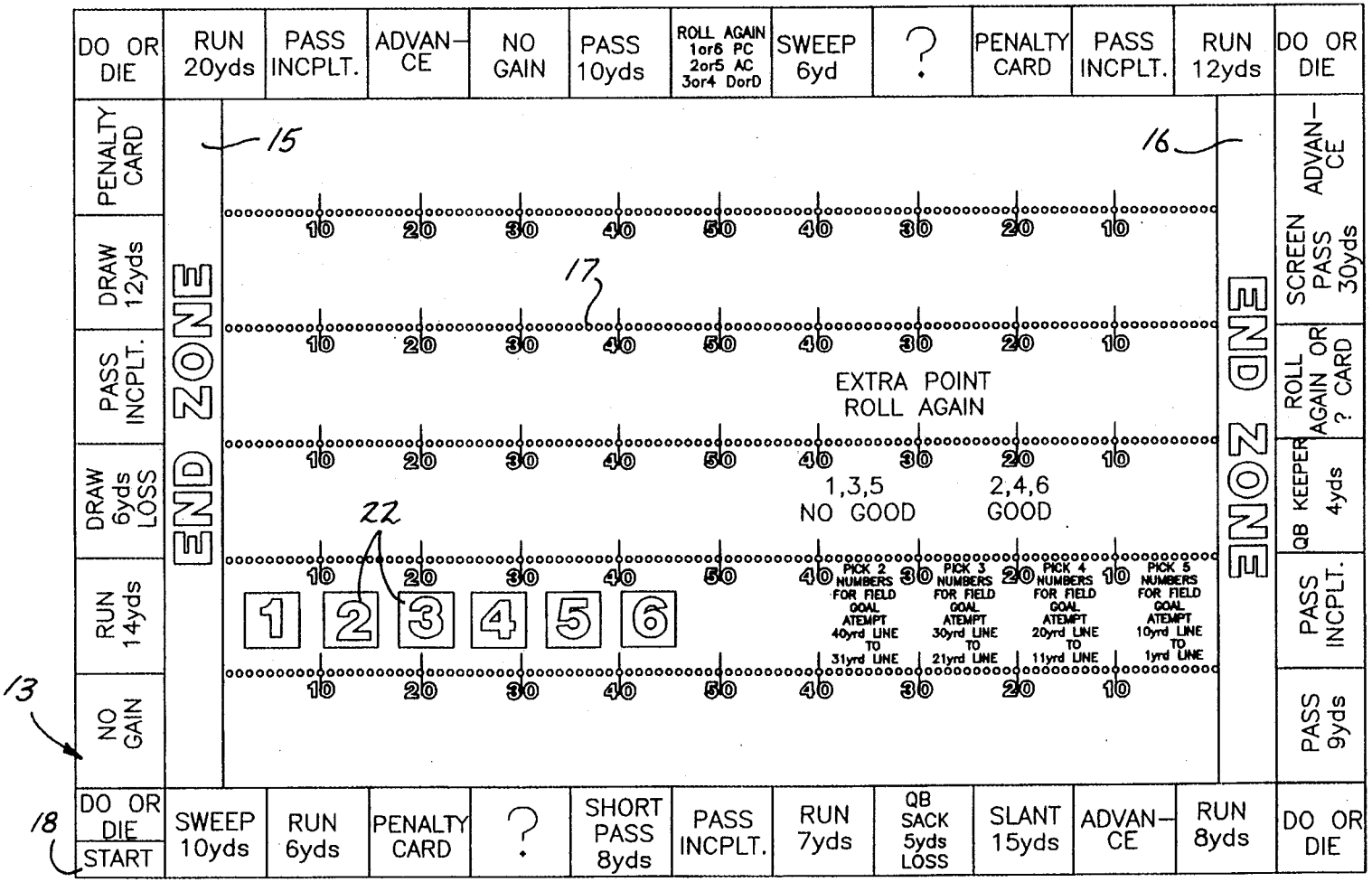
FIG. 3 is a top plan view of the playing board.
Figure 4:
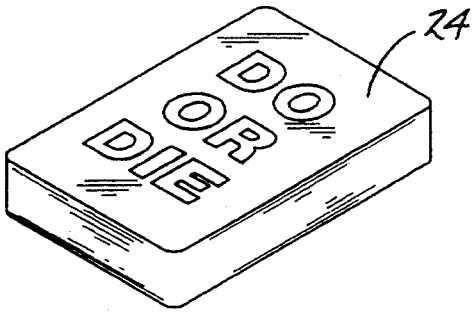
FIG. 4 is an isometric illustration of the first card members.
Figure 5:
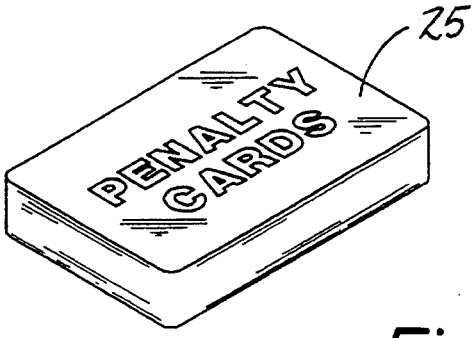
FIG. 5 is an isometric illustration of the second card members.
Figure 6:
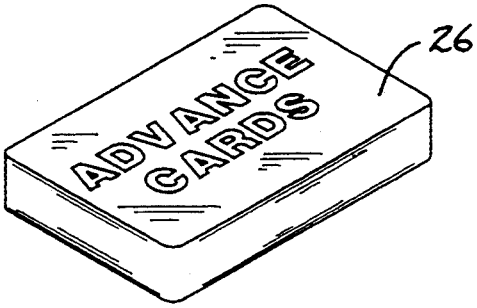
FIG. 6 is an isometric illustration of the third card members.
Figure 7:
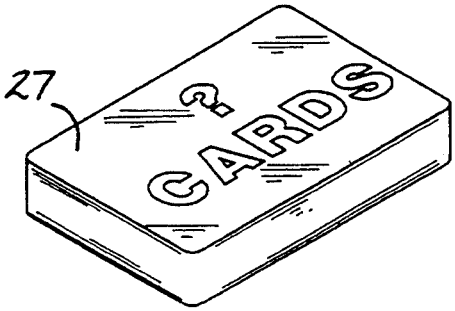
FIG. 7 is an isometric illustration of the fourth card members.
Figure 8:
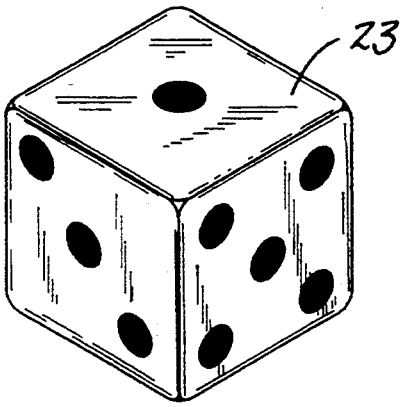
FIG. 8 is an isometric illustration of the die member employed by the invention.
Figure 9:
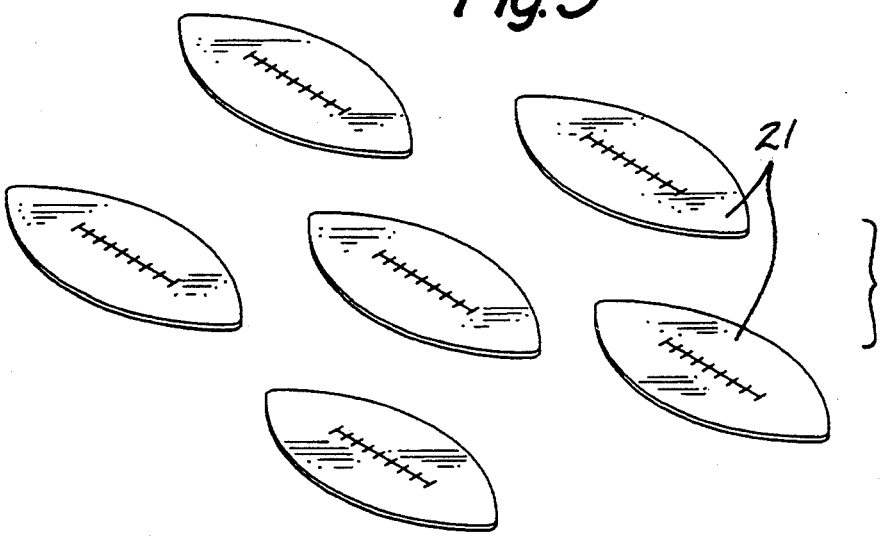
FIG. 9 is an isometric view of the placement tokens utilized onto the playing field.
Figure 10:
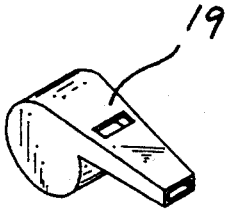
FIG. 10 is an illustrative example of a player space token.
Figure 11:
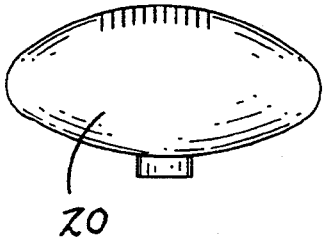
FIG. 11 and FIG. 12 are orthographic illustrations of aperture tokens, where one of such tokens is arranged for employment within an individual row of the apertures.
Figure 12:
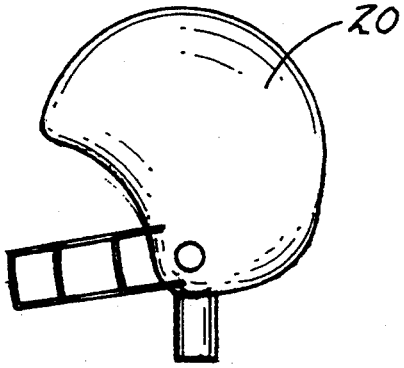

The football game 10 of the invention includes a game board 11 having a top surface and an outer periphery 12. A continuous array of instructional spaces 13 are directed continuously about the game board at the outer periphery to define a central space 14. The central space 14 is arranged to simulate a football playing field having a first end zone space 15 at a first end of the central space 14, with a second end zone space 16 at an opposed second end of the central space 14. Extending between the first and second end zone spaces 15 and 16 respectively are a plurality of rows of apertures 17. Each row of the rows of apertures includes one hundred such aperture openings to comply with a conventional one hundred yard playing field, such that each aperture approximates one yard of spacing. Further it should be noted that a start space 18 of the instructional spaces 13 is provided as a portion of one of the instructional spaces, wherein each player begins play employing a player space token 19. As exemplified by the FIG. 10, such contrasting configurations of player space tokens 19 are provided and other examples of such tokens may include a simulation of a football player, a referee, a football, and the like. Inasmuch as the game is intended for two to five players but not limited to this particular number, each of the rows 17 is arranged to receive an aperture token 20 of contrasting configuration, such as exemplified in the FIGS. 11 and 12, with each of the aperture tokens having a projection for complementary reception with one of the apertures of the rows of apertures 17. A die member 23 is illustrated as a six-sided configuration and employ enumeration from the numerals one through six or like designations. Further, respective first, second, third, and fourth cards 24, 25, 26, and 27 are provided. The first cards 24 are of a category to indicated "do or die". The second cards 25 are "penalty cards", the third cards 26 are "advance cards", with the fourth cards 27 of "question mark or mystery cards". The spaces 13 include seven category of spaces, not including the player start space 18, with four of the categories to include a first card category of the first cards 24, a second card category to include the second cards 25, a third card category to include the third cards 26, with a fourth card category to include a fourth card 27. A fifth card category directs players to advance along the rows of apertures 17, with a sixth category of cards indicating loss of spaces, wherein a player must descend relative to a row of apertures 17 along those openings, with a seventh category of spaces of the instructional spaces 13 to include a no-gain or loss, wherein a player does not advance or lose positioning relative to the row of apertures 17. The seven categories of spaces 13 as thusly enumerated are dispersed throughout the instructional spaces 13 , wherein a player landing on such a space is directed to comply with the instructions to either advance or descend relative to a row of apertures 17 relative to a goal.

Should a player be able to traverse the entire row of apertures 17, that player is then awarded a touchdown or six points, wherein the player may roll the die for an extra point, wherein the odd numbers 1, 3, and 5 prevent the player from receiving an extra point, whereas a rolling of a 2, 4, or 6 awards that player the extra point. Similarly, a player having moved along the row of apertures 17 between the 31 and 40 yard line of the opposing end zone, the player may place two of the placement tokens 21 on preselected numbers of the placement spaces 22. The rolling of the die 23 to a number of one of the preselected placement spaces 22 awards that player a field goal. Similarly, a player may pick three numbers of the placement spaces 22 enumerated 1–6. Should that player be directed between the 21 and 30 yard line of an opposing end zone, four such numbers of the placement spaces 22 may be selected upon a player being between the 11 and 20 yard line as indicated, and five of the spaces 22 may be selected by placing a placement token 21 thereon with the player being between the 1 and 10 yard line of the opposing end zone indicated as the second end zone space 16.

Preselected time periods may be employed for play of the game, such as with two or three players participating two fifteen minute hands would be employed for example, whereas four to five players would employ two thirty minute halves. Such time sequencing, however, is subject to mutual agreement by the players. It is understood that a touchdown is indicated as six points, an extra point one point, a field goal three points, with a safety being awarded an opposing player of two points should a player be directed to lose spaces and wind up in the first end zone space 15.

First cards 24 of the "do or die cards" are plays for big yardage and some plays that are for large loss of yardage. There is simply a combination of the instructions directed by the cards, wherein such examples are "late hit out of bounds, go up fifteen yards", wherein an opposing example in the first cards would be "offensive face mask go back five yards". It is understood that the advance or loss of "yardage" is directly linked to the number of apertures, such that an advance of five yards for example would be an advance of five of the apertures of the row of apertures 17. Further examples of the "do or die cards" may include "fumble go back eight yards", "roll again", "go to the nearest penalty space".

Examples of the second cards 25 or the "penalty cards" would be exemplified by "face mask go back fifteen", "off-side defensive five yards", "defensive face mask go up fifteen". These are only examples and are not limited thereto, wherein further examples are directed for the moving player to lose spaces or the opposing player to advance a number of spaces. The third cards 28 are the advance cards o direct players to advance, such that the advance cards may also employ directions to either proceed or lose spaces of the row of apertures 17 in a like manner such as "go back three spaces", "go back one space", or "move up three spaces". The fourth mystery cards or fourth cards 27 indicate a further chance in,the advance or decline in movement in the openings of the row of apertures 17, such that examples would be "quarterback keeper go up five yards", "quarterback sack go up five yards", "pass go up fourteen yards".

Subsequent to the preselected time period being expired, the player with a greatest point attainment is declared a winner.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A method of playing a football game, comprising the steps of, providing a game board, with the game board having a top surface and an outer periphery, and providing the game board with a continuous array of instructional spaces along the outer periphery, with the instructional spaces simulating a football field including a start space, and a central space contained within the instructional spaces and surrounded by the instructional spaces, and providing the central space with a first end zone spaced at a first end of the central space and a second end zone spaced at a second end of the central space, and further providing the central space with a plurality of rows of apertures extending between the first end zone and the second end zone, each row representing yardage on a football field, and further providing at least one player space token to be directed about the instructional spaces, and at least one apertured token arranged for each of the rows of apertures, and further including providing a die member, and wherein the die member is provided with a predetermined number of sides which are sequentially enumerated, and further providing for a row of placement spaces within the number of central space, wherein the placement spaces are equal to the predetermined number of sides of the die member, and the placement spaces are also sequentially enumerated, and further providing a plurality of placement tokens, wherein the number of placement tokens are equal to the number of placement spaces, and a player moving the player space token along the instructional spaces upon rolling of the die member, and said player moving the apertured token along one of the rows of apertures, from the first end zone toward the second end zone, according to the instructions of the instructional space landed on, said player being awarded a predetermined number of points upon reaching said second end zone, and said player also attempting to receive points by receiving a predetermined number of placement tokens less than the predetermined number of placement spaces, selectively placing the placement tokens on any of the placement spaces, only one placement token per placement space, rolling said die member, and upon said die member indicating one of said placement spaces having one of said placement tokens thereon, said player being awarded a yet further number of predetermined number of points.

* * * * *